US006743763B1

(12) United States Patent
Gopalkrishnan et al.

(10) Patent No.: US 6,743,763 B1
(45) Date of Patent: Jun. 1, 2004

(54) STABLE AQUEOUS LAUNDRY DETERGENTS CONTAINING VINYL PYRROLIDONE COPOLYMERS

(75) Inventors: Sridhar Gopalkrishnan, Grosse Ile, MI (US); Kathleen M. Guiney, Wyandotte, MI (US)

(73) Assignee: BASF Corporation, Mount Olive, NJ (US)

( * ) Notice: Subject to any disclaimer, the term of this patent is extended or adjusted under 35 U.S.C. 154(b) by 0 days.

(21) Appl. No.: 09/655,972

(22) Filed: Sep. 5, 2000

(51) Int. Cl.[7] ..... C11D 1/183; C11D 3/37; D06L 1/00

(52) U.S. Cl. ..... 510/360; 510/351; 510/356; 510/357; 510/413; 510/414; 510/421; 510/426; 510/475; 8/137

(58) Field of Search ..... 510/351, 356, 510/357, 360, 413, 414, 421, 426, 475; 8/137

(56) References Cited

U.S. PATENT DOCUMENTS

| | | | | | |
|---|---|---|---|---|---|
| 3,749,682 | A | * | 7/1973 | Tanner | 510/360 |
| 4,908,150 | A | * | 3/1990 | Hessel | 252/174.12 |
| 5,122,582 | A | * | 6/1992 | Potthoff-Karl | 526/81 |
| 5,167,871 | A | * | 12/1992 | Jollenbeck | 252/543 |
| 5,426,163 | A | * | 6/1995 | Buchler | 526/207 |
| 5,948,745 | A | * | 9/1999 | Cao | 510/321 |
| 6,025,316 | A | * | 2/2000 | Cao | 510/360 |

FOREIGN PATENT DOCUMENTS

| | | | | |
|---|---|---|---|---|
| CA | 1052220 | * | 4/1979 | C11D/1/86 |
| EP | 0262897 | * | 6/1988 | C11D/1/83 |
| EP | 0372291 | * | 6/1990 | C11D/3/37 |
| EP | 0892039 | * | 1/1999 | C11D/1/10 |
| EP | 913458 | * | 6/1999 | C11D/1/74 |
| FR | 2.166.112 | * | 8/1973 | C11D/1/00 |
| WO | 97/45518 | * | 12/1997 | C11D/3/39 |

* cited by examiner

*Primary Examiner*—Brian P. Mruk
(74) *Attorney, Agent, or Firm*—David T. Banchik

(57) ABSTRACT

Stable aqueous laundry detergents containing vinly pyrrolidone copolymers are provided. The stable aqueous laundry detergents contain, in addition to the vinyl pyrrolidone copolymers, a combination of anionic and nonionic surfactants.

13 Claims, No Drawings

STABLE AQUEOUS LAUNDRY DETERGENTS CONTAINING VINYL PYRROLIDONE COPOLYMERS

FIELD OF THE INVENTION

The invention relates to stable aqueous laundry detergents containing vinyl pyrrolidone copolymers. Specifically, this invention relates to stable aqueous laundry detergents that contain a copolymer of vinyl pyrrolidone and vinyl acetate, in combination with certain surfactants.

BACKGROUND OF THE INVENTION

Polyvinylpyrrolidone (PVP) is used in laundry detergents to complex vagrant dyes that are released from colored fabrics during the wash process and prevent their redeposition on other garments. This feature, called dye transfer inhibition, or DTI, can be exploited to maximize colorcare performance in powder laundry detergents. In powder detergents formulations, such PVP polymers can simply be dry-blended during the manufacture of powder detergents. In general, the dye-complexation efficiency of the polymer increases with increasing molecular weight of the polymer. Thus, PVP with a molecular weight of about 40,000 gives relatively better DTI, while PVP of a molecular weight of about 9,000 gives relatively poorer DTI, when used at identical levels.

It is also desirable to use nonionic surfactants in laundry compositions to increase the efficacy of the detergent in removing oily soil. Particularly preferred for this use are the commercially available alcohol ethoxylates. Likewise, anionic surfactants are commonly used in detergent compositions as soil removers. Particularly preferred for this use are the linear or branched alkylbenzene sulfonates.

Powdered laundry detergents containing PVP, nonionic surfactants, and anionic surfactants can be readily formulated either by conventional spray-drying techniques or by agglomeration. However, when PVP is incorporated into an aqueous detergent composition containing nonionic surfactants, stability problems are often encountered, especially when higher molecular weight PVP is used. The instability of an aqueous detergent composition manifests itself by phase separation upon standing. It is believed that the instability of such formulations is due to the incompatibility of the PVP and nonionic surfactant.

While it is desirable to use PVP of higher molecular weights because of the higher DTI, it is difficult to formulate stable aqueous detergent compositions containing both high molecular weight PVP and nonionic surfactant. However, it is possible to prepare stable aqueous detergent compositions containing nonionic surfactant by sacrificing the DTI properties thereof and incorporating therein lower molecular weight PVP.

It is an object of the invention to provide a detergent compositions containing both PVP copolymers and nonionic surfactant, which are aqueous-based, stable and exhibit acceptable DTI properties and oily soil detergency properties.

While it has been known to use certain PVP copolymers, including copolymers of vinyl pyrrolidone and vinyl acetate in powdered laundry detergent, such as disclosed in Tanner, U.S. Pat. No. 3,749,682, there remains a need to be able to incorporate such materials in a stable, aqueous detergent formulation.

We have found that stable, aqueous detergents can be prepared with certain copolymers of vinylpyrrolidone and vinyl acetate in combination with certain amounts of anionic and nonionic surfactants.

SUMMARY OF THE INVENTION

The present invention provides a stable aqueous laundry detergent composition comprising:

a) from 0.05 to 10 percent by weight of a copolymer comprising, as polymerized units,
   (i) from about 20 to about 80 mole percent vinyl pyrrolidone;
   (ii) from about 1 to about 80 mole percent vinyl acetate; and
   (iii) optionally, from 0 to about 20 mole percent of one or more additional polymerizable monomers;

b) from 5 to 60 percent by weight of a combination of
   (i) anionic surfactant; and
   (ii) nonionic surfactant having a cloud point measured in a 0.1 percent aqueous solution of less than 60° C.;
   wherein the weight ratio of anionic surfactant to nonionic surfactant is at least 3 to 1 when the detergent composition contains the copolymer at a level up to about 1 percent by weight, and
   wherein the weight ratio of anionic surfactant to nonionic surfactant is at least 4 to 1 when the detergent composition contains the copolymer at a level of at least about 1 percent by weight; and c) from 30 to 85 percent by weight water.

The present invention also provides a method for inhibiting dye transfer during washing of natural or synthetic fabrics wherein the fabrics are treated with a wash liquor comprising the stable aqueous laundry detergent composition described above.

DETAILED DESCRIPTION OF THE INVENTION

The stable aqueous laundry detergent composition of the invention comprises from about 0.05 to 10 percent by weight of a copolymer comprising, as polymerized units, from about 20 to about 80 mole percent vinyl pyrrolidone, from about 1 to about 80 mole percent vinyl acetate, and optionally, from 0 to about 20 mole percent of one or more additional polymerizable monomers. Preferably, the copolymer comprises, as polymerized units, vinyl pryrrolidone at a level of from about 50 to about 80 mole percent. Preferably, the copolymer comprises, as polymerized units, vinyl acetate at a level of at least about 20 mole percent, most preferably from about 20 to about 50 mole percent. The copolymer optionally comprise, as polymerized units, one or more additional polymerizable monomers. Suitable additional polymerizable monomers include, for example, acrylic acid, acrylic acid esters, maleic acid, maleic anhydride, ethylene, methacrylic acid, methacrylate esters and substituted methacrylate esters, vinyl imidazole, vinyl alcohol, methylvinyl ether, styrene, vinyl chloride, vinylidene chloride, acrylonitrile, methacrylonitrile, acrylamide, methacrylamide, crotonic acid, itaconic acid, and vinyl sulfonate. When used, the one or more additional polymerizable monomers are present in the copolymer at levels up to about 20 mole percent, preferably up to about 10 mole percent, most preferably up to about 5 mole percent.

The copolymers suitable for use in the present invention generally have a number average molecular weight of from about 5,000 to about 1,000,000, preferably from about 10,000 to about 100,000. Higher molecular weight polymers tend to be more difficult to synthesize, while lower number average molecular weight polymers lead to compositions with less than optimum detergency properties.

The copolymers are prepared by known methods, for example by radical polymerization of the monomers in a water miscible organic solvent. Suitable copolymers and methods for their preparation are described in U.S. Pat. No. 5,122,582, the disclosure of which is hereby incorporated by reference. Suitable copolymers for use in the present invention include certain commercially available vinyl pyrrolidone/vinyl acetate copolymers such as Luviksol® VA73W polyvinyl pyrrolidone polymer and Luviksol® VA64 polyvinyl pyrolidone polymer available from BASF Corporation.

The copolymers are present in the laundry detergent compositions of the present invention at a level of from 0.05 percent to 10 percent by weight. Preferably the copolymer is present in the laundry detergent compositions of the present invention at a level of less than about 5 percent by weight, more preferably at a level of less than about 3 percent by weight, most preferably at a level of less than about 2 percent by weight. For improving the DTI performance, the detergent compositions will preferably contain at least 0.1 percent by weight, more preferably at least 0.25 percent by weight, and most preferably at least 0.5 percent by weight of the copolymer.

The stable aqueous detergent compositions of the present invention also contain one or more anionic surfactants. A wide range of anionic surfactants is useful in the invention. Useful anionic surfactants include alkyl aryl sulfonates, alkyl sulfonates, alkyl sulfates, alkyl ether sulfates, alkyl phosphates, amine oxides, isethionates, $C_8$–$C_{30}$ fatty acid soaps, taurines, betaines, sulfobetaines, and mixtures thereof. A preferred anionic sufactant is LAS, which is an alkyl aryl sulfonate known as linear alkyl benzene sulfonate. It is commercially available, for example, as Biosoft® D-62 sodium alkyl benzene solfonate from Stepan. Another preferred class on anionic surfactant is the fatty acid soaps, for example, those formed from stearic acid. Preferably, the anionic surfactant in the stable aqueous detergent composition of the present invention will include a combination of LAS and other anionic surfactants such as the fatty acid soaps.

The stable aqueous laundry detergent compositions of the present invention also contain one or more nonionic surfactants having a cloud point of less than 60° C., measured in a 0.1 percent aqueous solution of the surfactant.

The nonionic surfactants will, in general, be polyoxyalkylene compounds, i.e., the product of reaction of alkylene oxides such as ethylene oxide or propylene oxide or mixtures thereof, with starter molecules that contain active hydrogen atoms that are reactive with the alkylene oxide. Such starter molecules include alcohols, amines, carboxylic acids, amides, and mercaptans. Where the starter molecule is an alcohol, the reaction product is known as an alcohol alkoxylate.

The polyoxyalkylene compounds can have a variety of block and heteric structures. For example, they can comprise a single block of alkylene oxide, or they can be diblock alkoxylates or triblock alkoxylates. Within the block structures, the blocks can be all ethylene oxide or all propylene oxide, or the blocks can contain a heteric mixture of alkylene oxides.

In general, a wide range of nonionic surfactants is useful in this invention. A preferred nonionic surfactant is selected from the class of alcohol ethoxylates, which are alcohol alkoxylates where the alkylene oxide is ethylene oxide. The alcohols used to make the alcohol alkoxylates and the preferred ethoxylates of the invention are, in general, those having from 6 to 18 carbon atoms. A suitable surfactant is an adduct of seven ethylene oxide units with a single $C_{12}$–$C_{15}$ alcohol unit. Such surfactants are known to those of skill in the art under various designations. For example, it may be referred to as a 7-mole ethoxylate of a $C_{12\text{-}15}$ alcohol, or a 7 ethylene oxide adduct, or a $C_{12\text{-}15}$ alcohol 7 mole ethoxylate, or a 7 eo adduct of a $C_{12\text{-}15}$ alcohol. All such naming conventions are used interchangeably in the art as well as here.

Within a class of nonionic surfactants, it is generally observed that the cloud point of a 0.1 percent aqueous solution of the surfactant goes up with increasing ethylene oxide content. For example, where the nonionic surfactants are ethoxylates of a $C_{12}$–$C_{15}$ alcohol, it is observed that the 7-mole ethoxylate has a cloud point less than 60° C., whereas the 9-ethylene oxide adduct has a cloud point greater than 60° C. Alcohol alkoxylates with less than about 8 ethylene units will, in general, have a cloud point in a 0.1 percent aqueous solution of less than 60° C. Nonionic surfactants comprising an alcohol ethoxylate with fewer than about 8 ethylene oxide units are preferred in the stable aqueous compositions of the invention.

The combination of anionic surfactant and nonionic surfactant are present in the stable aqueous detergent compositions of the present invention at a level of from 5 to 60 percent by weight. The nonionic surfactant is present in the stable aqueous detergent composition of the present invention at a level sufficient to impart effective oily soil detergency. In general, the desired level will vary depending on the application and the detergency properties required. Subject to the limitation on total surfactant and the ratio of anionic to nonionic surfactant discussed below, the nonionic surfactant is generally present at levels of from about 1 to about 15 percent by weight, preferably from about 4 to about 10 by weight, of the stable aqueous detergent composition.

The anionic surfactant and nonionic surfactant are present in the stable aqueous detergent compositions of the invention in a weight ratio of least 3:1 when the detergent composition contains the copolymer at a level up to about 1 percent by weight. The anionic surfactant and nonionic surfactant are present in the stable aqueous detergent compositions of the invention in a weight ratio of least 4:1 when the detergent composition contains the copolymer at a level up to about 1 percent by weight.

The aqueous laundry detergent compositions of the present invention comprise from 30 to 85 percent by weight water, preferably, from about 40 to about 70 percent by weight.

The detergent compositions of the present invention may also contain one or more conventional additives found in liquid laundry detergents or other aqueous detergent compositions. Such additives are known to those of skill in the art, and include, for example: antiredeposition agents; bleaches; builders such as sodium sulfate or sodium carbonate; buffers such as borax; defoamers; enzymes; brighteners; enzyme stabilizers; solvents such as ethanol or glycerol; hydrotropes such as sodium xylene sulfonate; preservatives; softening agents such as quarternary ammonium salts; formulation aids such as sorbitol; fragrances; dyes; and colorants.

The types of additives used, and the levels of additives in the formulations, will be chosen by the skilled formulator to produce compositions with the desired detergency and other properties. For a general discussion, see Surfactant Science Series, vol. 67*Liquid Detergents*, edited by Kuo-Yann Lai (Marcel Dekker, 1997), and especially chapter 8 on Heavy-Duty Liquid Detergents, the disclosures of which are hereby incorporated by reference.

Aqueous laundry compositions are suitably formulated by adding the surfactant components to the water, then adding the other ingredients with stirring. The compositions of the present invention are stable, which provides sufficient shelf life for the product between the time it is formulated and the time it is finally used in a laundry application by the consumer. Cleaning and dye transfer inhibition of synthetic and natural fabrics is readily accomplished by treating the fabrics in a wash liquor containing the aqueous detergent compositions, in either a soak basin where the washing is done manually, or in an automatic washing machine.

Table 1 shows the results of dye transfer inhibition experiments with copolymers of vinyl pyrrolidone and vinyl acetate, having molecular weights as shown in Table 1, in a dry laundry formulation. The results are expressed as Delta Rd, from a Tergotometer study. Delta Rd refers to the loss in whiteness—the greater the Delta Rd, the greater is the loss in whiteness, indicating poorer DTI performance. The Tergotometer study was conducted with reactive brown 32 dye at 5 parts per million, with ten-minute wash and five-minute rinse, 150 parts per million hardness water (Ca:Mg=2:1), and six cotton swatches per pot.

In the experiments summarized in Table 1, below, the copolymer was added to the following base detergent formulation at the level indicated in percent by weight based on the base detergent composition. The base detergent formulation was prepared by combining, of 20 parts by weight of a $C_{12-15}$ alcohol 7 mole ethoxylate, 30 parts by weight soda ash, 10 parts by weight sodium sulfate, 10 parts by weight sodium silicate, and 30 parts by weight zeolite. The detergent composition containing the copolymer was added to the wash liquor at a 0.1 percent by weight use level.

TABLE 1

| mole percent vinyl pyrrolidone in copolymer | Number average molecular weight of copolymer | Level of copolymer in formulation, % by weight | Delta Rd |
|---|---|---|---|
| 100 | 45,000 | 2 | 7.2 |
| 70 | 33,000 | 2 | 6.7 |
| 70 | 33,000 | 1 | 12.2 |
| 60 | 44,000 | 2 | 8 |
| 50 | 66,000 | 2 | 8.5 |
| — | — | 0 (control) | 17.2 |

From Table 1, it is seen that the control experiment with no polymer gave a Delta Rd of 17.2. Detergent compositions containing the copolymers described above as being useful in the present invention showed DTI properties. A detergent composition containing 2 percent of a polyvinylpyrrolidone polymer resulted in a Delta Rd of 7.2. A detergent composition containing 2 percent of a copolymer having a 50:50 mole ratio of vinyl pyrrolidone units to vinyl acetate units resulted in a Delta Rd of 8.5.

EXAMPLES

In the following Examples, the following abbreviations are used:

"LAS" is Biosoft® D-62 sodium alkylbenzene sulfonate, a linear alkylbenzene sulfonate commercially available from Stepan.

"Neodol® 25-7 Neodol® 257 primary alcohol ethoxylate." It is a $C_{12-15}$ alcohol ethoxylate, with 7 unites of ethylene oxide per unit alcohol, commercially available from Shell. The cloud point is a 0.1% by weight aqueous solution is about 48° C.

"Neodol® 1-7 Neodol® 1-7 primary alcohol ethoxylate. It" is a $C_{11}$ alcohol ethoxylate, with 7 units of ethylene oxide per unit of alcohol, from Shell. The cloud point is a 0.1% by weight aqueous solution is about 58° C.

"VA73W" is Luviskol® VA73W polyvinyl pyrrolidone polymer. It is a copolymer of 70% vinyl pyrrolidone and 30% vinyl acetate, with a number average molecular weight of 33,000. It is sold by BASF Corporation.

"VA64" is Luviskol® VA64 poly vinylpyrrolidone polymer. It is a copolymer of 60% vinyl pyrrolidone and 40% vinyl acetate, sold by BASF Corporation. The number average molecular weight is about 44,000.

Stability of the test formulas in Examples 1–14 was determined at room temperature and at 50° C. The experiments involved placing samples of the formulations (described below and as set forth in Tables 2 and 3) in closed containers for two weeks at either room temperature or in an oven set at 50° C. If after the two week period, the test formula was homogeneous with no phase separation, then stability is reported as "yes" in Tables 2 and 3 below. If after two weeks, the test formula showed phase separation or inhomogeneity, then the stability is reported as "no". Stable compositions, which form part of the invention, are those which are stable for two weeks both at room temperature and at 50° C. Stability of Examples 1–4 was not determined at room temperature, because the results at 50° C. indicated they were unstable and therefore not part of the invention.

The stability of detergent compositions having the components set forth in Table 2 were determined. The numbers appearing the Table are the percent by weight of the component present in the detergent formulation. In addition to the components set forth in Table 2, below, the formulations used in Examples 1–8 also contained 4% sodium xylene sulfonate, 4% borax, 6% glycerin, and 2.7% sorbitol, with all percentages being based on the total weight of the formulation.

The stability of detergent compositions having the components set forth in Table 3 were determined. The numbers appearing the Table are the percent by weight of the component present in the detergent formulation. In addition to the components set forth in Table 3, below, the formulations used in Examples 9–14 also contained 0.5% by weight sodium sulfate, 4% by weight sodium carbonate, and 1.5% by weight sodium xylene sulfonate, with all percentages being based on the total weight of the formulation.

TABLE 2

| Component | Ex. 1 | Ex. 2 | Ex. 3 | Ex. 4 | Ex. 5 | Ex. 6 | Ex. 7 | Ex. 8 |
|---|---|---|---|---|---|---|---|---|
| LAS | 7 | 7 | 7 | 14 | 18 | 18 | 24 | 24 |
| Neodol ® 25-7 | 17 | 17 | | 10 | 6 | 6 | — | — |
| Neodol ® 1-7 | | | 17 | | | | — | — |
| VA73W | 1 | | | 1 | | 1 | | 1 |
| VA64 | | 1 | 1 | | 1 | | 1 | |
| water | 58.3 | 58.3 | 58.3 | 58.3 | 58.3 | 58.3 | 58.3 | 58.3 |
| stability, 50° C. | no | no | no | no | yes | yes | yes | yes |
| stability, room temp. | not det'd | not det'd | not det'd | not det'd | yes | yes | yes | yes |

TABLE 3

| Component | Ex. 9 | Ex. 10 | Ex. 11 | Ex. 12 | Ex. 13 | Ex. 14 |
|---|---|---|---|---|---|---|
| LAS | 17.4 | 17.4 | 18.4 | 18.4 | 22.8 | 22.8 |
| Stearic acid | 1.1 | 1.1 | 1.1 | 1.1 | 1.1 | 1.1 |
| Neodol ® 25-7 | 5.4 | 5.4 | 4.4 | 4.4 | | |
| VA73W | | 1.4 | | 1.4 | 1.4 | |
| VA64 | 1.4 | | 1.4 | | | 1.4 |
| water | 68.7 | 68.7 | 68.7 | 68.7 | 68.7 | 68.7 |
| stability, 50° C. | yes | yes | yes | yes | yes | yes |
| stability, room temp. | no | no | yes | yes | yes | yes |

Examples 1–8 demonstrate the effect of the weight ratio of anionic surfactant to nonionic surfactant on the stability of the detergent formulations containing the copolymer at a level of 1% by weight. The anionic surfactant is represented by LAS or stearic acid, while the nonionic surfactant is represented by Neodol® 25–7 primary alcohol sulfonate or Neodol® 1–7, primary alcohol sulfonate. In Examples 1–3, which resulted in unstable formulas, the weight ratio was 7 anionic to 17 nonionic, or about 0.4:1. In Example 4, also unstable, the weight ratio of anionic to nonionic was 1.4:1. In Examples 5–6, the weight ratio was 3:1 anionic to nonionic, and the formulas were stable at room temperature and at 50° C. Examples 7 and 8 contained no nonionic surfactant, and are considered to be outside the scope of the invention.

Examples 9–14 demonstrate that stable detergent formulations can be made which contain greater that 1% by weight copolymer, if the weight ratio of anionic surfactant to nonionic surfactant is above about 4:1. The weight ratio of anionic surfactant to nonionic surfactant was determined by adding together the amount of LAS and the amount of stearic acid, then dividing by the amount of Neodol 25–7 Neodol® 35–7 primary alcohol sulfonate. In Examples 9 and 10, the weight ratio was 3.4:1, and the formulations were unstable. In Examples 11–12, the weight ratio was 4:4:1, and the formulas were stable.

We claim:

1. A stable aqueous laundry detergent composition comprising:

a) from 0.05 to 10 percent by weight of a copolymer comprising, as polymerized units, (i) from about 20 to about 80 mole percent vinyl pyrrolidone;

(ii) from about 1 to about 80 mole percent vinyl acetate; and (iii) optionally, from 0 to about 20 mole percent of one or more additional polymerizable monomers;

b) from 5 to 60 percent by weight of a combination of (i) anionic surfactant; and (ii) nonionic surfactant having a cloud point measured in a 0.1 percent aqueous solution of less than 60° C.;

wherein the weight ratio of anionic surfactant to nonionic surfactant is at least 3 to 1 when the detergent composition contains the copolymer at a level up to 1 percent by weight, and wherein the weight ratio of anionic surfactant to nonionic surfactant is at least 4 to 1 when the detergent composition contains the copolymer at a level of at least 1 percent by weight; and c) from 30 to 85 percent by weight water.

2. The composition of claim 1, wherein the copolymer is present at a level of at least one percent by weight of the composition and the weight ratio of anionic surfactant to nonionic surfactant is at least 4 to 1.

3. The composition of claim 1, wherein the nonionic surfactant comprises an alcohol ethoxylate with fewer than 8 ethylene oxide units.

4. The composition of claim 3, wherein the nonionic surfactant comprises a $C_{12-15}$ alcohol with 7 ethylene oxide units.

5. The composition of claim 1, wherein the copolymer comprises, as polymerized units, from about 50 to about 80 mole percent vinyl pyrrolidone.

6. The composition of claim 1, wherein the number average molecular weight of the copolymer is from about 10,000 to about 100,000.

7. The composition of claim 1, wherein the copolymer comprises, as polymerized units, about 70 mole percent vinyl pyrrolidone and about 30 mole percent vinyl acetate.

8. The composition of claim 1, wherein the copolymer comprises, as polymerized units, about 60 mole percent vinyl pyrrolidone and about 40 mole percent vinyl acetate.

9. The composition of claim 1, wherein the anionic surfactant is selected from the group consisting of alkyl aryl sulfonates, alkyl sulfonates, alkyl sulfates, alkyl phosphates, amine oxides, isethionates, $C_8$–$C_{30}$ fatty acid soaps, taurines, betaines, sulfobetaines, and mixtures thereof.

10. A method for inhibiting dye transfer during the washing of natural or synthetic fabrics, comprising treating the fabrics with a wash liquor comprising the composition of claim 1.

11. A method for inhibiting dye transfer during the washing of natural or synthetic fabrics, comprising treating the fabrics with a wash liquor comprision the composition of claim 2.

12. A method for inhibiting dye transfer during the washing of natural or synthetic fabrics, comprising treating the fabrics with a wash liquor comprising the composition of claim 7.

13. A method for inhibiting dye transfer during the washing of natural or synthetic fabrics, comprising treating the fabrics with a wash liquor comprising the composition of claim 8.

* * * * *